US005562575A

United States Patent [19]

Gvoich

[11] Patent Number: 5,562,575

[45] Date of Patent: *Oct. 8, 1996

[54] RECOILING EXERCISE BENCH

[75] Inventor: Ned Gvoich, Beamsville, Canada

[73] Assignee: Kor-One, Ltd., Scottsdale, Ariz.

[ * ] Notice: The term of this patent shall not extend beyond the expiration date of Pat. No. 5,387,166.

[21] Appl. No.: 346,492

[22] Filed: Nov. 29, 1994

Related U.S. Application Data

[63] Continuation-in-part of Ser. No. 164,014, Dec. 8, 1993, Pat. No. 5,387,166, and a continuation-in-part of Ser. No. 276, 479, Jul. 18, 1994, abandoned.

[51] Int. Cl.[6] ..... A63B 23/04

[52] U.S. Cl. ..... 482/52; 482/51; 482/26; 482/27

[58] Field of Search ..... 482/77, 31, 30, 482/51, 9, 52, 26, 27, 148, 57, 140, 142, 130, 111, 112

[56] References Cited

U.S. PATENT DOCUMENTS

| | | | |
|---|---|---|---|
| D. 277,220 | 1/1985 | Herburger . | |
| 1,509,750 | 9/1924 | Campbell . | |
| 1,638,350 | 8/1927 | Long . | |
| 3,195,890 | 7/1965 | Salls . | |
| 3,219,358 | 11/1965 | Hagner . | |
| 3,466,031 | 9/1969 | Boykin, Jr. . | |
| 3,522,953 | 8/1970 | Gold et al. . | |
| 3,634,895 | 1/1972 | Childers . | |
| 3,641,601 | 2/1972 | Sieg . | |
| 4,037,834 | 7/1977 | Oaks . | |
| 4,196,903 | 4/1980 | Illustrato . | |
| 4,199,136 | 4/1980 | Mansfield . | |
| 4,253,661 | 3/1981 | Russell . | |
| 4,279,415 | 7/1981 | Katz | 482/51 |
| 4,316,297 | 2/1982 | Geist | 5/420 |
| 4,323,231 | 4/1982 | Wilson | 272/65 |
| 4,460,170 | 7/1984 | Lundberg et al. | 272/65 |
| 4,492,374 | 1/1985 | Lekhtman et al. | 482/77 |
| 4,730,826 | 3/1988 | Sudmeier . | |
| 5,087,037 | 2/1992 | Morrow . | |
| 5,096,186 | 3/1992 | Wilkinson et al. . | |
| 5,112,045 | 5/1992 | Mason et al. . | |
| 5,116,045 | 5/1992 | Jahoda . | |
| 5,118,096 | 6/1992 | Wilkinson et al. . | |
| 5,184,987 | 2/1993 | Wilkinson . | |
| 5,205,798 | 4/1993 | Lekhtman | 482/77 |
| 5,269,735 | 12/1993 | Pfitzenmeier . | |
| 5,290,210 | 3/1994 | Hand et al. | 482/51 |
| 5,387,166 | 2/1995 | Gvoich | 482/77 |

FOREIGN PATENT DOCUMENTS

| | | | |
|---|---|---|---|
| 0183388 | 3/1907 | Germany . | |
| 2738297 | 3/1979 | Germany | 482/23 |
| 0700149 | 11/1979 | U.S.S.R. . | |
| 1172568 | 8/1985 | U.S.S.R. . | |
| 1710083 | 2/1992 | U.S.S.R. . | |

*Primary Examiner*—Richard J. Apley
*Assistant Examiner*—Jerome Donnelly

[57] ABSTRACT

An adjustable, recoiling aerobic exercise bench which reduces the generation and transmission of impaction forces on a user's joints while performing conventional and power step exercises includes a resilient platform slidingly disposed in left and right housings which function to support the platform above and relative to an exercise floor surface. Lateral platform recoiling assemblies are disposed between the platform ends and inside lateral walls of the housings and are adapted to generate lateral, resistive, restoring forces when the platform is moved downward during operation of the device. A vertical platform recoiling assembly which includes a plurality of rigid tubular spring retainers and telescoping springs, is mounted beneath the undersurface of the platform and is of sufficient length so as to make contact with the exercise floor surface to generate a vertical platform resistive restoring force when the platform is downwardly compressed. The ends of the platform are freely movably mounted within the housings to permit longitudinal movement of the platform ends therein when a vertical force is applied to the platform.

11 Claims, 11 Drawing Sheets

RECOILING EXERCISE BENCH

CROSS REFERENCE TO RELATED APPLICATION

This application is a continuation-in-part of U.S. Ser. No. 08/164,014, filed Dec. 8, 1993, now U.S. Pat. No. 5,387,166, and is a continuation-in-part of U.S. Ser. No. 08/276,479, filed Jul. 18, 1994, now abandoned.

BACKGROUND OF THE INVENTION

1. Technical Field

This invention relates to an improved, adjustable, recoiling aerobic exercise step bench. Adjustable height, aerobic step benches are widely accepted as a preferred means to facilitate aerobic training through exercise.

2. Background Information

Various types of step benches are available for use in an aerobic exercise program, in both the home and professional gym environments. Many of these devices provide for variation of the exercise intensity by providing adjustability of the bench height. However, recently the fitness industry has popularized a new aerobic stepping technique termed "power stepping." The conventional step aerobic exercises involve a simplistic step-up and step-down exercise technique. Power stepping technique is a substantially higher intensity and aggressive variation of the conventional technique and is best described as the vertical or lateral catapulting of the user's body off of the bench platform. The exerciser increases the lower limb range of motion and the speed of the muscle contraction and thereby the explosive force generated by the leverage of the joints and by the muscles of the lower limbs and buttocks. This power stepping is similar to the leap of a basketball player from a crouch prior to initiating a vertical leap toward a basket. Power stepping dramatically increases the aerobic intensity of the exercise as compared to a conventional bench stepping technique. However, the generation and transmission of the impaction forces to the exerciser's lower limb and spinal joints is proportionately increased with the power stepping technique.

It is well-documented that activities which generate and transmit impaction forces to the body's joints, such as jogging, are detrimental to the exerciser's joints. The avoidance or dampening of the generation or transmission of the impaction forces with respect to these types of exercising is therefore a desirable effect.

Various, related prior art exercise benches are known. However, none of these benches effectively address the problems associated with the generation and transmission of impaction forces to the exerciser's joints during their operation, especially during power stepping exercises. Certain prior art devices can reduce the potential for the generation and transmission of impaction forces; however, their inherent designs prohibit adaptation for use in a exercise bench.

There is, therefore, a need for a recoiling, aerobic exercise bench which effectively reduces the impaction forces generated by the operation of the bench and/or transmitted to the user's body joints while permitting variation in the intensity of the exercise by providing adjustability of the bench height.

OBJECTS OF THE INVENTION

Accordingly, it is an object of the present invention to provide a recoiling, adjustable aerobic bench which is an improvement over existing devices due to effectively reducing the physiologic stress associated with the generation of joint impaction forces while performing the conventional aerobic bench stepping exercise technique or the power stepping aerobic exercise technique.

Another object of the present invention is to provide a recoiling, adjustable bench device which remains stable and restricts creeping of the device along the exercise floor surface as the user reciprocally steps on and off of the device.

Yet another object of the present invention is to provide a recoiling, adjustable bench device which may be selectively and incrementally adjusted in its height to thereby permit sequential increases in the intensity of the associated exercise.

Another object of the invention is to provide a bench device which may be manufactured in two sizes: a shorter, compact size for home or apartment use and a longer size for use in the professional gym setting.

A still further objective of the invention is to provide a bench device in which the ends of an arcuate platform are slidably mounted or "floating" in a pair of spaced end supporting members to permit a flattening movement of the platform when experiences vertical forces thereon and to prevent tipping of the bench.

Still a further object of the invention is to provide a bench device which is simple to manufacture, affordable, lightweight, yet durable and reliable.

Other objects of the invention will become evident when the following description of this invention is considered with the accompanying drawings.

SUMMARY OF THE INVENTION

The present invention overcomes inadequacies of conventional aerobic bench devices by providing an easy to manufacture, light-weight, yet durable and stable recoiling, adjustable climbing exercise bench which effectively reduces the generation and transmission of impaction forces to the joints of the foot, knee, hip, pelvis and spine of a user while performing conventional or power stepping aerobic exercises, and including a provision for variably increasing the intensity of the exercise by the selective raising or lower of the bench platform height.

Accordingly, in general terms the device includes: a resilient, upwardly arched platform, slidingly mounted within a channel of a left and right housing, a means for vertically and horizontally anchoring the platform, i.e., maintaining a stationary position of the platform with respect to a exercise floor surface; lateral recoiling assemblies disposed within the housing channels adapted to generate a lateral resistive restoring force to the elongation of the platform during operation of the device; vertical recoiling assemblies having top ends secured to the platform undersurface and bottom ends in constant contact with the exercise floor surface and adapted to generate a vertical resistive restoring force to counter the downward displacement of the platform during operation of the device; a stop member mounted on each of vertical recoiling assembly and adapted to limiting the downward compression of the platform during operation of the device; and risers for variably adjusting the height of the device.

In more detail, the preferred embodiment of the present invention comprises: a substantially resilient, upwardly arched platform including substantially rounded end retainer bars rigidly attached at the left and a right platform ends and slidingly mounted within left and right channels formed within a left and right housing so as to retain the platform above, an exercise floor surface, the housings having a lateral wall inclined from vertical at an acute angle so as to improve stability of the device during use; an elastomeric strip disposed within the left and right channels of the housings, between the end retainer bars and inside lateral walls of the housings, so as to form a lateral recoiling assemblies adapted to generate lateral, resistive, restoring forces against the platform during operation of the device housing end caps adapted to horizontally retain the platform within the channels of the housings; a plurality of rigid tubular spring retainers, being of sufficient length and adapted to maintain constant contact with the exercise floor surface during operation of the device; a non-skid shoe mounted to the bottom end of the spring retainer so as to protect the floor surface and resist tipping or creeping of the device during use; a spring of predetermined compressibility mounted within the spring retainers and adapted to resist downward movement of the platform and thereby to generate a vertical recoiling of the platform during operation of the device; a shock absorbing rubber cylindrical collar, including a circular bore, slidingly disposed on the spring retainers so as to limit the downward; a plurality of attachable risers adapted to be selectively mountable to the left and right housings by the interengagement of groove mounting elements provided on the undersurface of the housings with a corresponding tongue mounting provided on a top surface of the risers so as to permit the risers to be slidably engaged in a locking position with the housings, and including additional risers having corresponding grooves and tongues on their bottom and top surfaces so as to permit the selective mounting of risers to risers; and also including a plurality of risers adapted to be mountable to the bottom end of the spring retainers to permit a uniform, incremental adjustment in the platform height of the bench device.

In a further embodiment, the present invention comprises: first and second end members; an arcuate flexible platform having a top surface and a pair of ends; and retention means for retaining each of the platform ends within a respective one of the end members and for permitting outward movement of said platform ends within said end members when a vertical force is applied on the top surface of said platform.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
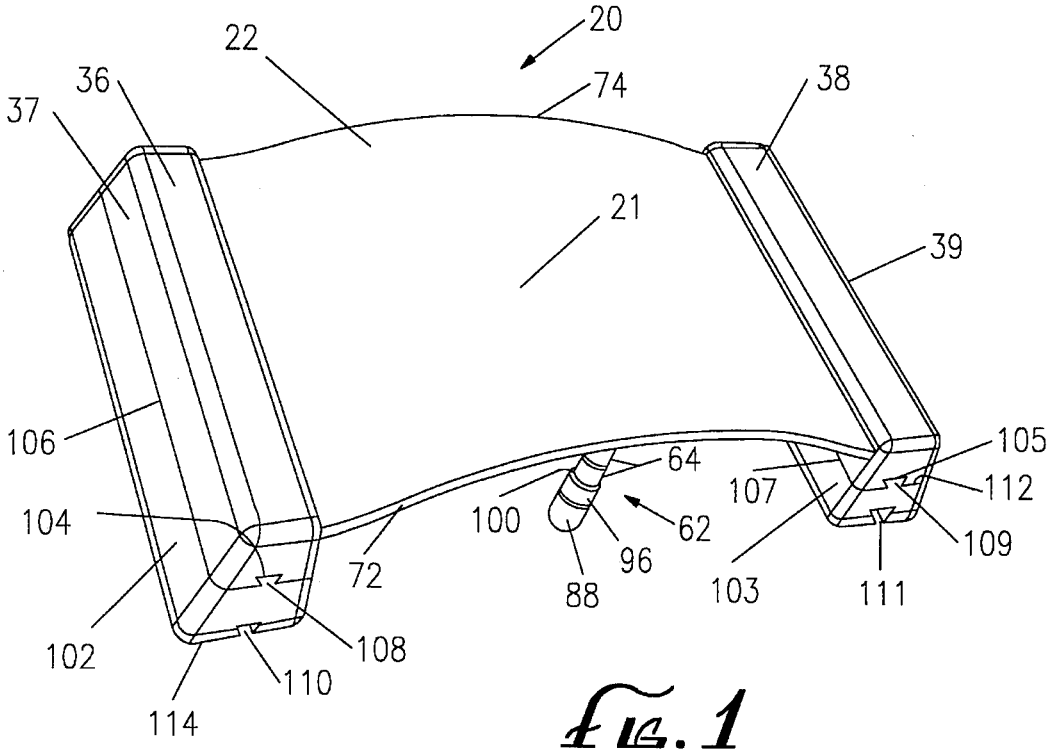
FIG. 1 is a perspective view of a preferred embodiment of the recoiling exercise bench of the present invention.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalents and alternative constructions falling within the spirit and scope of the present invention, as defined in the appended claims.

Figure 2:
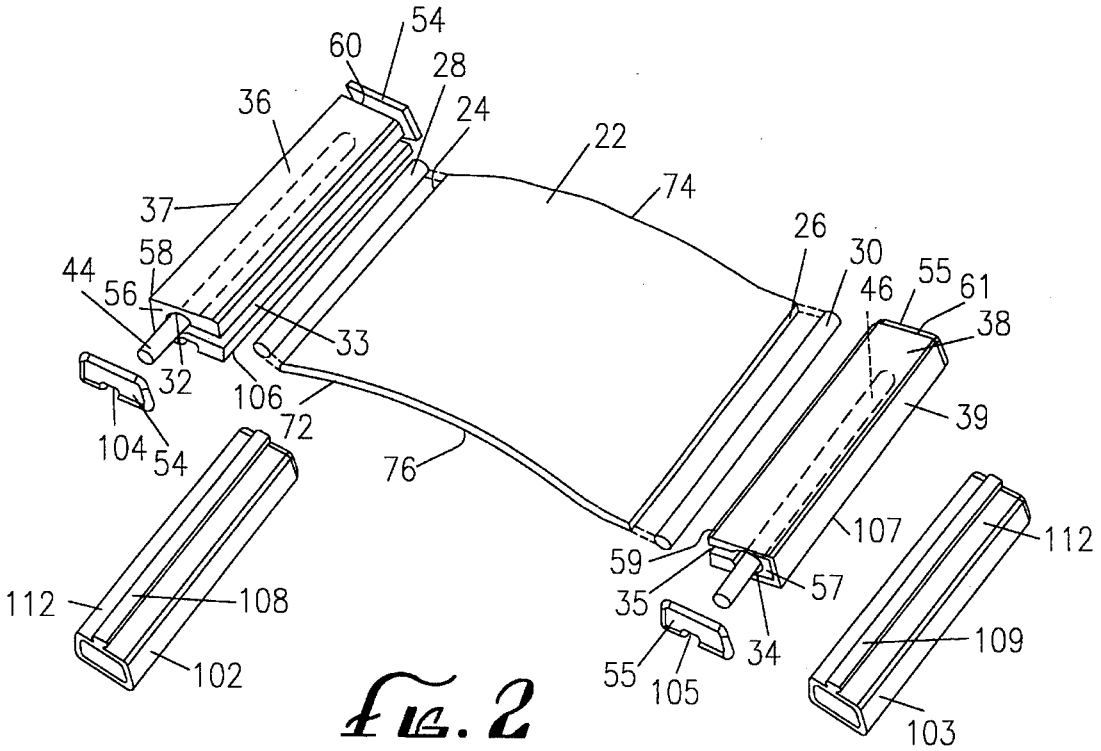
FIG. 2 is a partially exploded view of the recoiling exercise bench FIG. 1.
Figure 3:
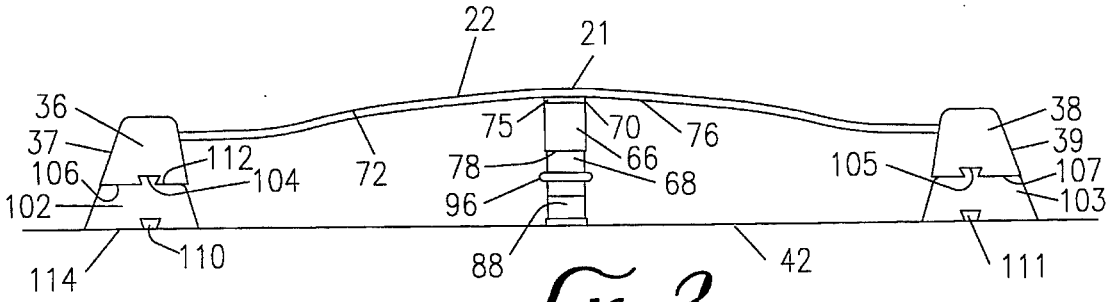
FIG. 3 is an front elevational view of the FIG. 1 bench.

As shown in FIGS. 1–3, a recoiling adjustable aerobic exercise bench 20 includes a resilient platform 22 of predetermined length and width sufficient to permit a full range of exercise movements associated with conventional and power step aerobic exercising. Platform 22 is preferably upwardly arched in cross-section with respect to the exercise floor surface 42 and with the apex 21 positioned intermediate the length of the platform 22. The platform 22 can be made using other cross-sectional configurations so long as the platform 22 cooperates with other components of the bench 20 to permit recoiling of the platform 22 during use of the bench 20. Platform 22 is preferably fabricated from a resilient and flexible plastic, although virtually any other resilient and flexible material, such as plywood, a laminated wood panel, and some metals or various woods, may be used.

Referring to FIG. 2 left end 24 and right end 26 of platform 22 include left and right platform retainer bars 28 and 30, respectively. The bars 28, 30 are substantially round in cross section and have a diameter large enough to keep them retained in channels 32, 34. The left and right channels 32 and 34, respectively, are integrally formed in the interior of left and right housings 36 and 38, respectively, and are of a sufficient size to permit longitudinal sliding movement of the platform ends therein upon the platform experiencing a downward force. The housings are preferably trapezoid in cross-section, with the bottom dimension greater than the top dimension, to provide increased stability. The bars 28 and 30 are, preferably, securely attached to platform ends 24 and 26, respectively, by an conventional means, but may alternately be integrally formed at the platform ends 24 and 26. Housings 36 and 38 include laterally and downwardly sloping lateral walls 37 and 39 which function to improve stability and prevent creeping of the bench 20 along exercise floor surface 42 during use.

Bottom surfaces 106, 107 of the left and right housings 36 and 38, respectively, include grooves 104 and 105. The grooves 104, 105 are sized to accommodate complimentary tongues 108 and 109 on the top surfaces of risers 102 and 103. A plurality of risers 102 and 103 may be used to provide for adjustment of the height of the platform 22 above the floor 42. The tongue and groove features of the housings and risers 102 and 103 may have virtually any cross-sectional shape so long as they function to reliably fasten risers 102 and 103 to each other and the risers 102 and 103 to the housings 36 and 38. The grooves are preferably integrally formed in bottom surface 106 and 107 of the housings and on top surface 112 of the risers 102 and 103 so as to permit adjustment of the height of the housings 36 and 38 of the bench 20. Housings 36 and 38 and the risers 102 and 103 preferably are made from a substantially rigid material such as plastic, wood or metals sufficiently strong enough to vertically support and laterally secure platform 22 at a pre-determined distance above the floor surface 42 during use.

Figure 4:
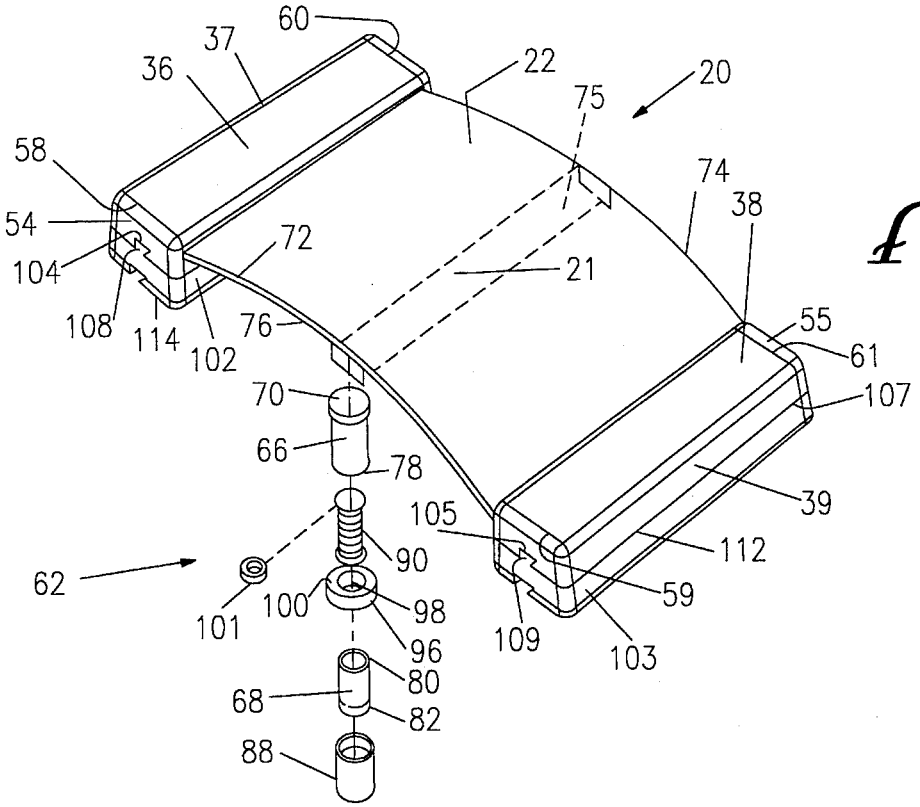
FIG. 4 is an perspective view of the bench of FIG. 1 showing the vertical recoil assembly exploded.
Figure 5:
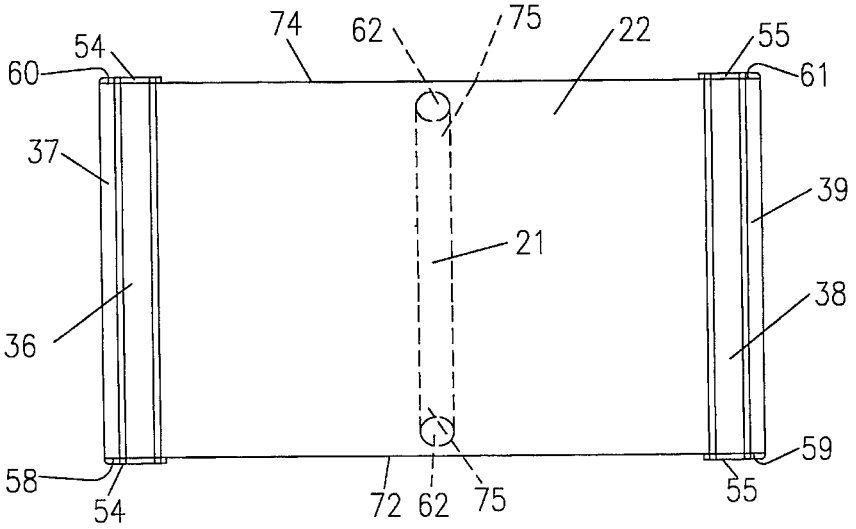
FIG. 5 is a top plan view of the FIG. 1 bench.
Figure 6:
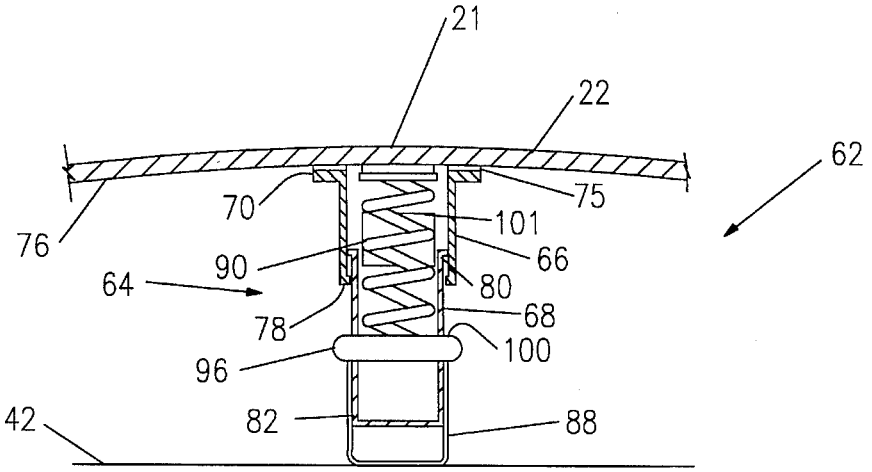
FIG. 6 is a partial cross-sectional view of a vertical recoil assembly of the FIG. 1 bench.

As best seen in FIGS. 2, 3 and 4, end caps 54, 55 are connected to open ends 56, 57 located at front edges 58, 59 and back edges 60, 61 of the housings 36 and 38 by any conventional means, such as by press fitting or by gluing. The end caps are sized and shaped to cover the openings and may be made from any material sufficiently rigid enough to prevent the left and right end retainer bars 28 and 30 from sliding laterally out of the channels 32 and 34 of housings 36 and 38, respectively, during use.

Figure 7:
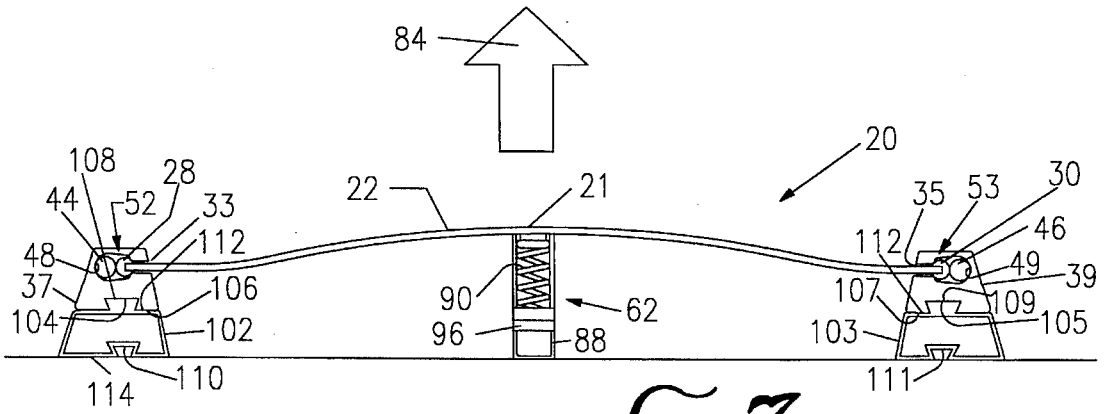
FIG. 7 is a front elevational view of the FIG. 1 bench showing attachment risers to the housings and the platform in a resting platform configuration.
Figure 8:
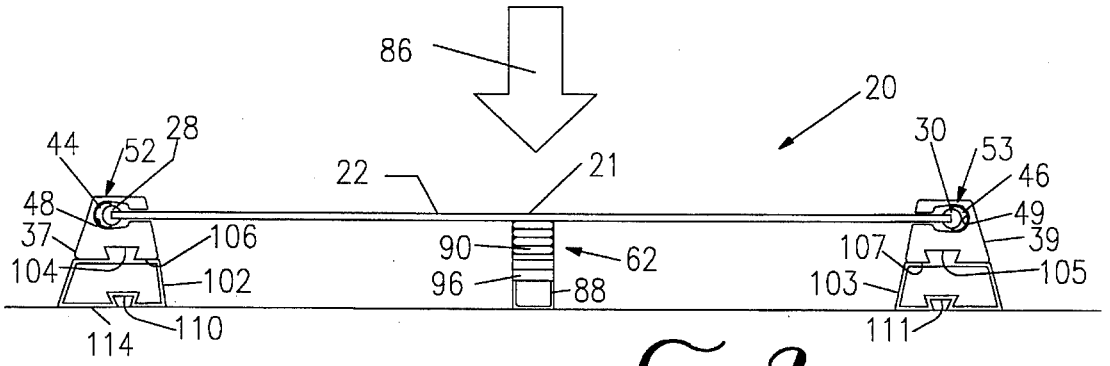
FIG. 8 is a front elevational view of the FIG. 1 bench showing attachment of risers to the housings, additional, separate risers, and the platform is a compressed configuration.

Referring to FIGS. 2, 7 and 8, lateral recoil assemblies 52, 53 include left and right elastomeric strip 44 and 46, respectively. The strips are of pre-determined compressibility and memory, disposed within lengthwise channels 32 and 34 of housings 36 and 38 and between inside lateral walls 48, 49 of the channels 32 and 34 and the retainer bars 28 and 30 of platform 22, respectively. In FIG. 8, the strips 44, 46 are shown compressed and in FIG. 7 are shown relaxed. The strips function to resist the lateral forces generated by movement of arched platform 22 when platform 22 is downwardly compressed as shown in the direction of arrow 86 in FIG. 8. The strips also function to recoil platform 22 to its original shape as shown in FIG. 7. Elastomeric strips 44 and 46 may alternatively comprise springs, air cylinders or equivalents, so long as the strips function to provide lateral platform resistive and/or restoring forces to the platform 22 during operation of the bench 20. Alternatively, lateral recoiling means 52 and 53 may be eliminated if platform 22 has sufficient resiliency recovery to return to its original shape after outward movement of its ends within channels 32 and 34.

As best seen in FIGS. 4, 6, 7 and 8, a vertical recoil assembly 62 includes a rigid tubular spring retainer 64 formed by the rigid upper tube 66, which telescopes over rigid lower tube 68 of a smaller diameter. A top end 70 of the upper spring retainer tube 66 is mounted on undersurface 76 of platform 22. Preferably at least two vertical recoil assemblies 62 are fastened to the undersurface 76 of the platform. For example, assemblies 62 may be mounted intermediate the length of platform 22, at front edge 72 and at back edge 74, with a connecting plate or bar 75 spanning the platform 22 width and rigidly connecting spring retainers 64 at the top ends 70 so as to evenly distribute the downward compression forces, shown by arrow 86, exerted by the platform 22 into the vertical recoil assembly 62 during use of the bench 20. Bottom end 78 of the upper retainer tube 66 receives and engages with a top end 80 of the lower retainer tube 68 in a conventional manner, such as with complimentary inner and outer lips, or flanged ends, respectively. The length of the telescoping upper tube 66 and lower tube 68 is sufficient to maintain bottom end 82 of the lower retainer tube 68 in constant contact with the exercise floor surface 42 through a non-skid shoe 88. Shoe 88, of a predetermined length, functions to protect the exercise floor surface 42 and resist creeping o the bench 20 along the floor surface 42. Shoe 88, of course, may be made of different lengths, and/or made to be adjustable in height so as to provide for the selective, uniform and incremental raising of the bench 20 to thereby provide for variation in the intensity of the exercise by providing for adjustment of the vertical distance of motion permitted the platform 22 during use. Spring retainer 64 is preferably formed of metal but may be formed from any substantially rigid material including numerous plastics.

In each assembly 62 a spring 90, of pre-determined load capability, spring constant and size is mounted within the tubular spring retainer 64. Spring 90 functions to resist the downward compression, shown at arrow 86 in FIG. 8, of platform 22 and to restore platform 22 to its original shape as at arrow 84 during operation of the bench 20. Air cylinders or other equivalent means may be used as substitutes for the springs 90, so long as they function to resist compression of platform 22 and restore platform 22 to its original configuration during operation of the bench 20.

Referring to FIG. 4, rubber, shock absorbing cylindrical collar 96, including a circular bore 98 is slidingly disposed around the lower retainer shaft 68 of the assembly 62. The collar functions to limit downward travel of the upper retainer shaft 66 on the lower shaft 68 by the abutment of the bottom end 78 of the upper tube 66 with a upper end surface 100 of collar 96 when the platform 22 is fully compressed. The maximum length of downward travel of spring retainer 64 is determined by the vertical dimension of collar 96. A plurality of cylindrically shaped rubber stoppers 101, shown in FIG. 6, may be selectively mounted between any two or more coils of spring 90 so as to stiffen springs 90 and thereby permit adjustment of the compressionability of spring 90 and to accommodate exercisers 118 of different body weight. Spring 90 may alternatively be substituted with an elastomeric material, air cylinder or other equivalent means so as to eliminate the need for spring retainer 64, collar 96 and stopper 101 so long as the vertical recoil assembly 62 has recoiling properties sufficient to function as a platform resistive and restoring force during operation of the bench 20. Spring 90 may be made from any compressible shock absorbing material suitable for spring construction. Stopper 101 may be made from any substantially stiff material.

As best shown in FIGS. 7 and 8, the left risers 102 and right risers 103 include tongues 108, 109 integrally formed in top surfaces 112 and complimentary grooves 110, 111 integrally formed in bottom surface 114 of the risers 102 and 103 so as to permit the selective attachment of risers 102 to the bottom surface 106, 107 of the housings. Selective attachment of a additional left and right risers 102 and 103 to the bottom surface 114 of attached risers 102 and 103 may also be accomplished in a similar fashion and as illustrated in FIGS. 7 and 8. Also, non-skid shoes 88 of varying dimensions may be attached to the bottom ends 82 of spring retainer 64 so as to provide for the incremental raising or lowering of the platform 22 of the bench 20. The risers 102 and 103 attached to the bottom surface 114 of the risers 102 and 103, combined with the plurality of variable height, non-skid shoes 88 attached to the bottom ends 82 of spring retainers 64 provide for the incremental raising or lowering of the platform 22 of the bench 20. The risers 102 and 103 and shoes 88 may be formed of any substantially rigid material such as rubber, plastic, wood or metal.

Where used here to describe the preferred embodiment, the terms "integral" and "integrally formed" mean that the parts referred to are portions of a single unit, preferably a plastic, wood or metal material, and formed using an injection molding, blow molding, extrusion molding or casting molding fabrication process. However, other forms of attachment may be suitable, consistent with minimizing production cost and enhancing reliability. The term "rigid" means that the parts referred to are preferably made of tubular-shaped plastic or metal materials. The terms "rigidly attached" or "rigid attachment" means that the parts referred to are screwed, glued or otherwise fastened together.

Figure 9:
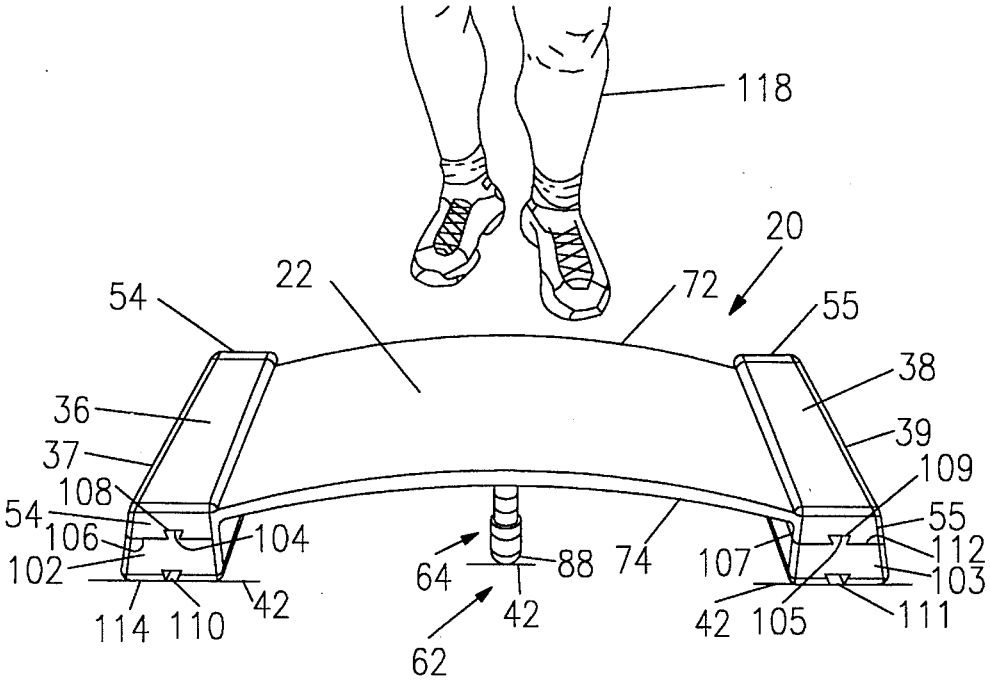
FIG. 9 is a perspective view of the FIG. 1 bench during use by an exerciser and demonstrating the resting or recoiled configuration of the platform.
Figure 10:
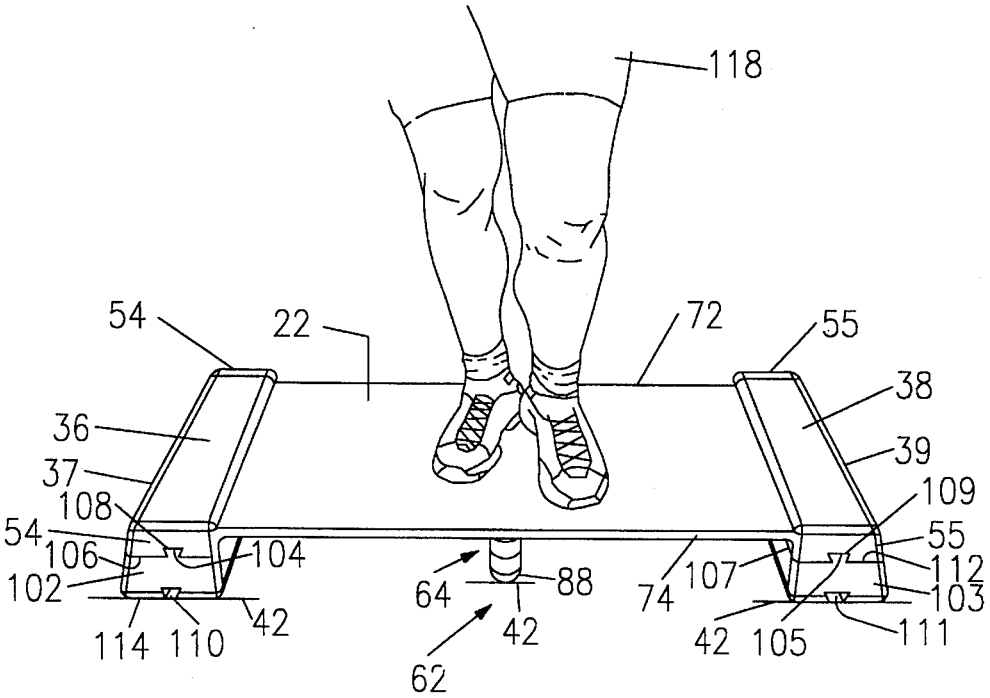
FIG. 10 is a perspective view of the FIG. 1 bench during use by an exerciser and demonstrating the loaded, weighted or compressed configuration of the platform.

Referring to FIGS. 9 and 10, operation of the bench 20 of the present invention will be described. A person 118 is shown stepping onto, and off from, the platform 22 of the bench 20 after adjustment of the platform 22 height by the selective attachment or detachment of left and right risers 103, 103 to the undersurfaces 106 of the housings 34 and 36, respectively. The attachment of risers 102, 103 to the housings and the selective attachment of shoes 88 to the bottom end 82 of spring retainers 64 is accomplished so as to select the desired exercise intensity, according to the platform 22 height. The platform 22 is shown in FIG. 9 in a relaxed position wherein no weight is borne on the platform 22 and in FIG. 10 is shown in a fully compressed position. It may be seen that platform 22 distorts or flattens, under the user's body weight, by the flattening of the platform 22 arch toward the floor surface 42 and by the lateral movement of the edges of the platform 22 into the channels 32 and 34 of housings 36 and 38 and against the elastomeric strips 44 and 46 supported by the inside wall 48, 49 of the channels 32 and 34. The combined operation of the housings 36 and 38, the channels 32 and 34, the recoiling elastomeric strips 44 and 46, the telescoping recoiling spring retainers 64 and springs 90 permit the lateral and vertical distortion of the platform 22 while preventing the creeping of the bench 20 along the floor surface 42.

In use, the exerciser's 118 stepping maneuvers are assisted by the recoiling response of the platform 22. Immediately upon stepping onto the platform 22, the exerciser 118 initiates an upward thrusting of his or her body, the bottoming out of the spring retainer downward travel 94 being prevented by springs 90, collar 96, stoppers 101, and shoes 88. The springs 90 are preferably of sufficient compression strength so as to counter the exerciser's 118 weight. The compression strength and operation of the springs may be modified by the selective attachment of rubber stoppers 101 between any two coils of springs 90. Also, abutment of the upper spring retainer shafts 66 into the top end surface 100 of collars 96 contribute to the operation of the device by further limiting and modifying the vertical travel of the platform 22, and in conjunction with the rapidity of the exerciser's movements, provide a springing assistance to the exerciser's 118 stepping maneuvers as the exerciser 118 performs power step exercises on platform 22, thereby effectively reducing the generation and the transmission of impaction forces to the body joints of the exerciser 118.

Figure 11:
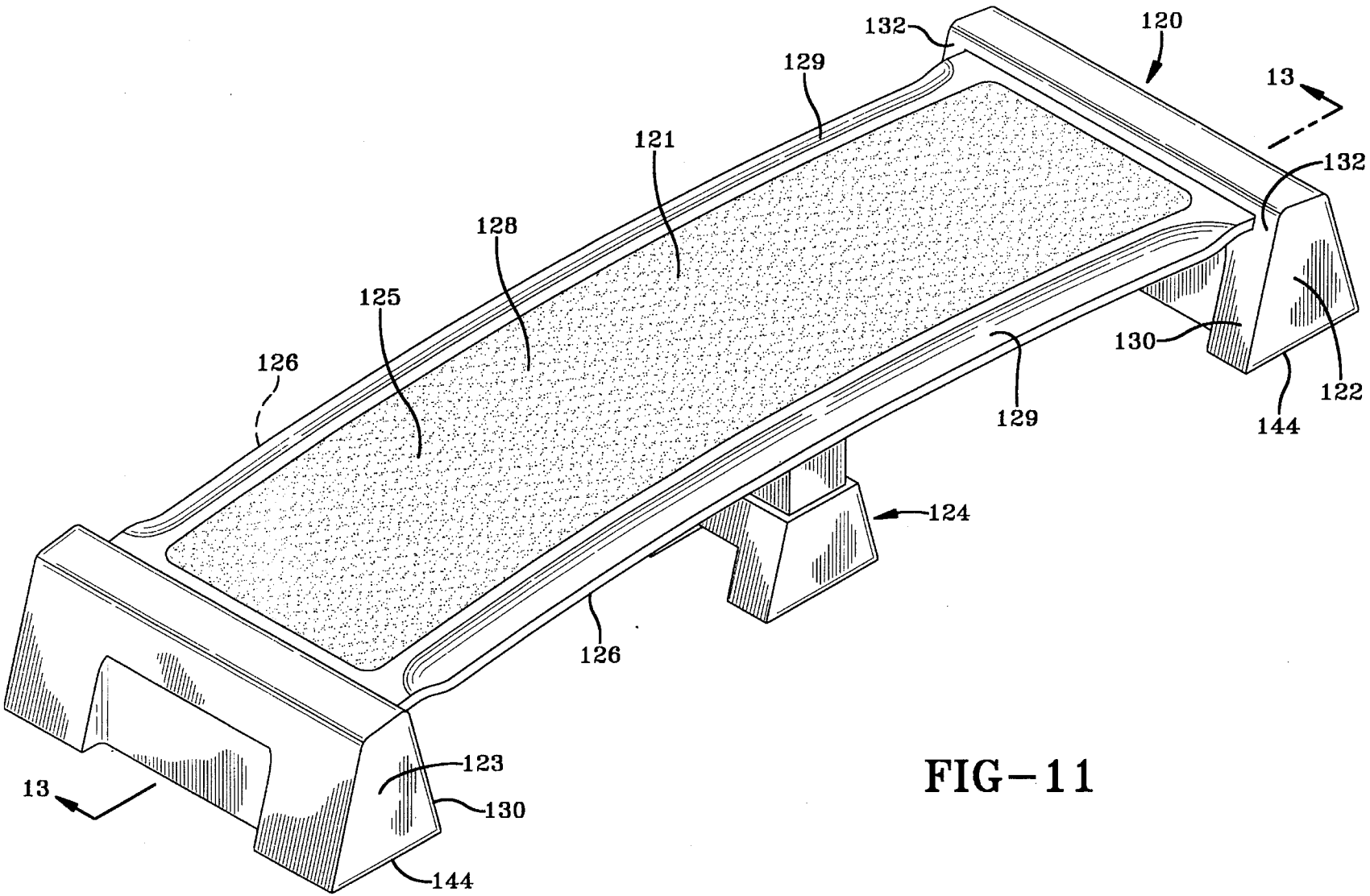
FIG. 11 is a perspective view of a second embodiment of the present invention.

A second embodiment of the present invention is shown in FIG. 11, and is indicated generally at 120. Exercise bench 120 is similar to exercise bench 20 described hereinabove in that it includes an arcuate platform 121, a right housing 122, a left housing 123 and a vertical recoil assembly 124.

Figure 12:
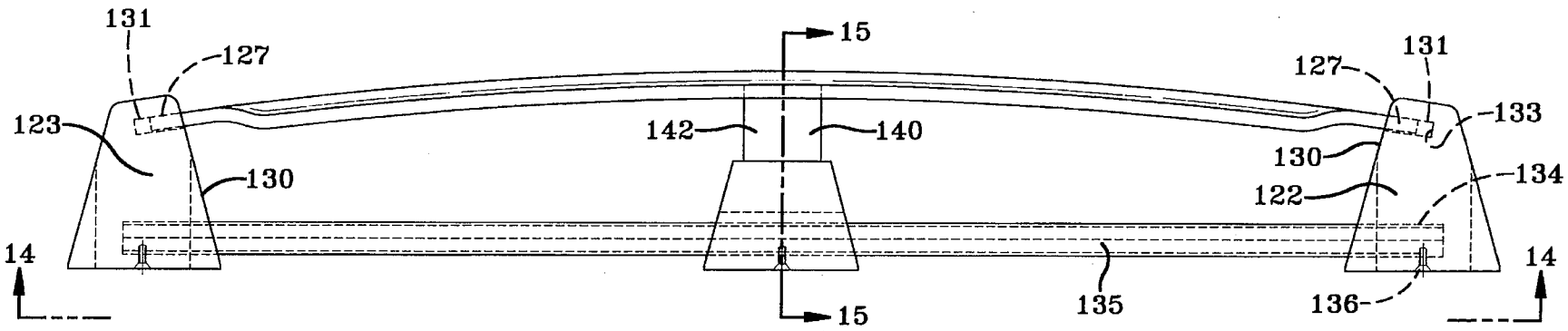
FIG. 12 is a side elevational view of FIG. 11.

Platform 121 includes a top surface 125, spaced apart longitudinal generally parallel side edges 126, and spaced apart ends 127 normal to edges 126 (FIG. 12). Top surface 125 includes a non-skid coating 128. Longitudinal edges 126 include bevels 129 extending away from top surface 125 and along the platform 121 intermediate right housing 122 and left housing 123. Bevels 129 increase the spring rate and strength of platform 121 thereby permitting a constant platform strength and spring rate even if the platform thickness is reduced.

Figure 13:
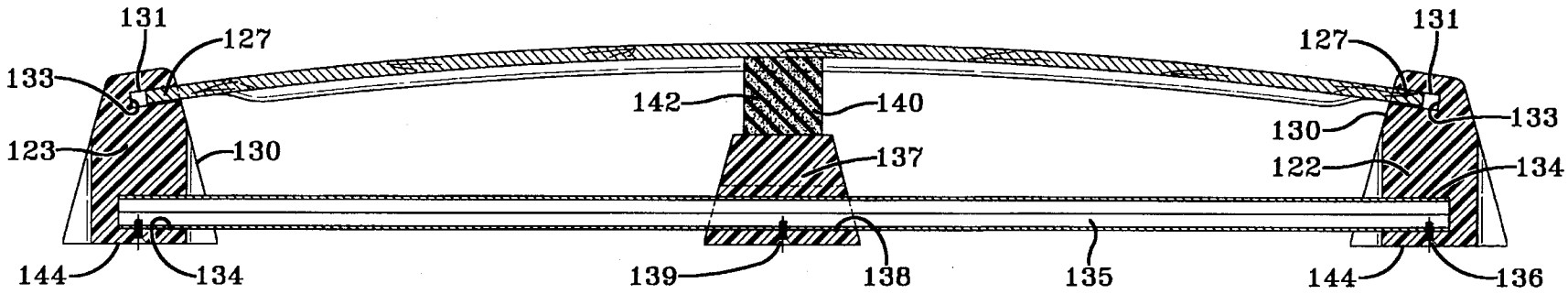
FIG. 13 is a sectional view of the second embodiment of the present invention taken along line 13—13, FIG. 11.
Figure 14:
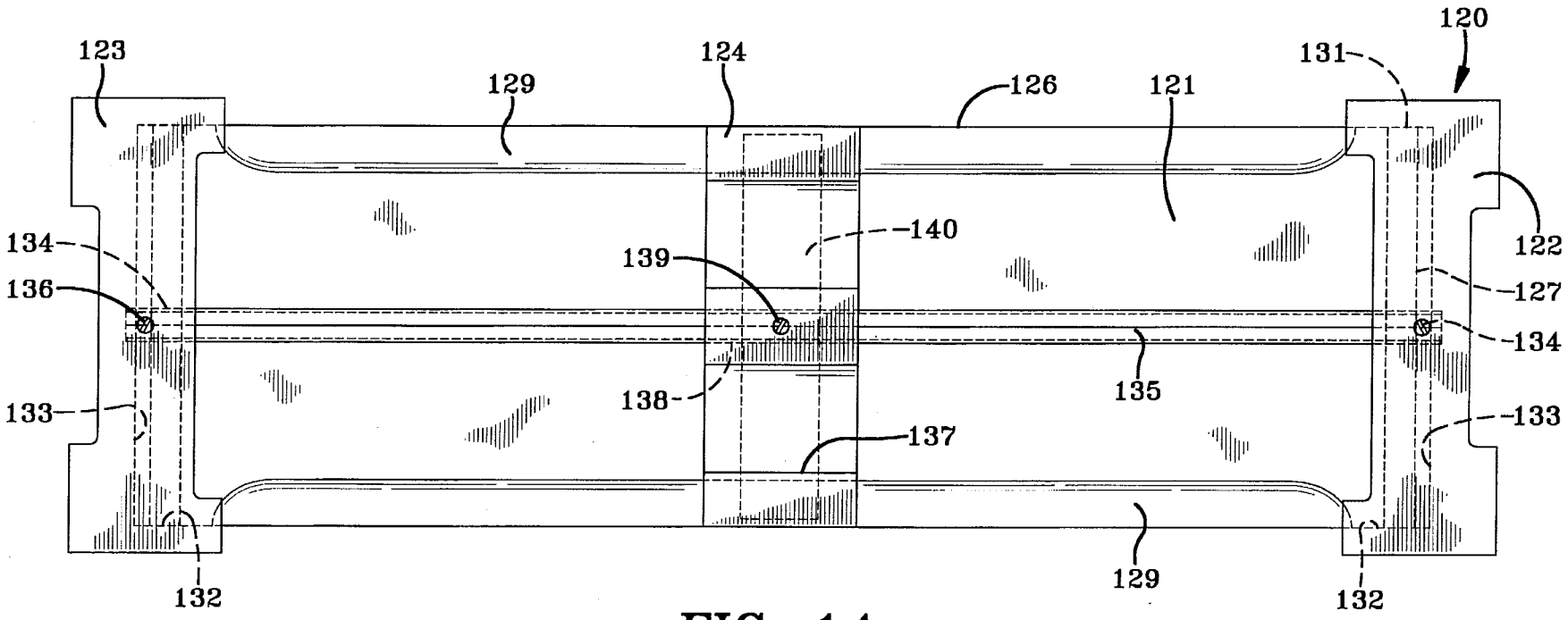
FIG. 14 is a bottom plan view of the second embodiment of the present invention.

Referring to FIGS. 12–13, right housing 122 and left housing 123 each include a sloped inner wall 130 formed with a double-blind slot 131 and a bottom wall 144 for supporting the bench on a support surface. Each end of each slot 131 terminates at a shoulder 132 (FIG. 11) and is of a size and configuration sufficient to slidably receive a corresponding end 127 of platform 121 therein. Moreover, slot 131 provides a void 133 between each end 127 of platform 121 and the corresponding right or left housing 122 and 123 for purposes which will become more apparent hereinbelow.

Both right and left housings 122 and 123, respectively, include a hole 134 which receives a rigid stretcher bar 135 therein (FIGS. 12–13). A set screw 136 retains an end of stretcher bar 135 within each hole 134. As should be apparent to one of ordinary skill in the art, stretcher bar 135 may have a variety of configurations without departing from the spirit of the present invention, with a square bar being shown in the preferred embodiment. Stretcher bar 135 stabilizes the bench by preventing the lower portions of housing 122 and 123 from attempting to pivot outwardly when a downward force is exerted on the platform.

Figure 15:
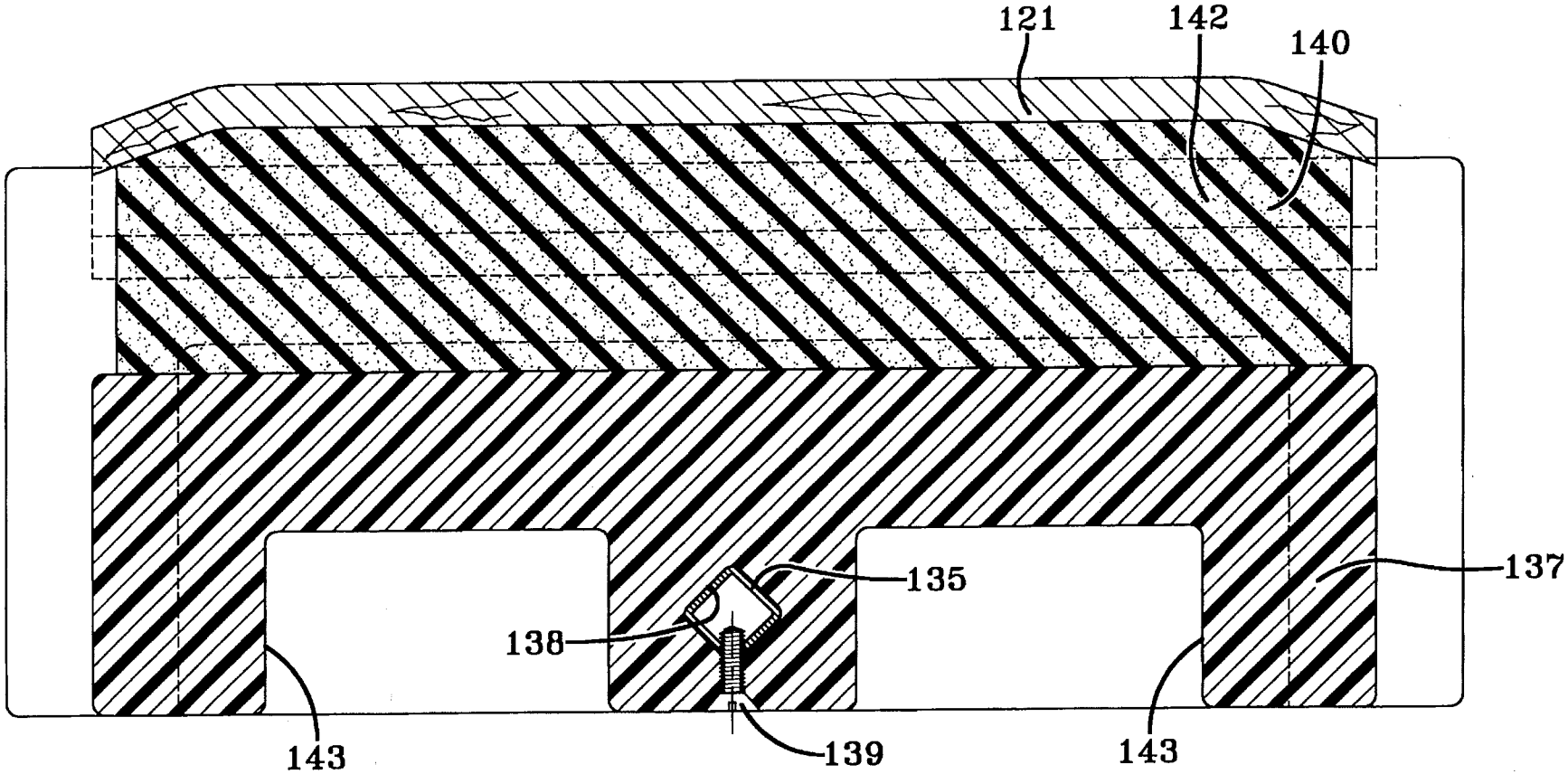
FIG. 15 is an enlarged sectional view taken along line 15—15, FIG. 12.

Vertical recoil assembly 124 includes a trapezoidal-shaped leg 137 having a through aperture 138 for receiving stretcher bar 135 (FIG. 15). A pair of cutouts 143 (FIG. 15) is formed in leg 137 to increase its stability if used on an uneven support surface. A set screw 139 retains stretcher bar 135 in an aperture 138 of leg 137. As should be apparent to one of ordinary skill in the art, stretcher bar 135 may be a rigid one-piece member extending between holes 134 in right housing 122 and left housing 123. Alternatively, stretcher bar may be two bars, one bar extending between right housing 122 and leg 137, and a second bar extending between leg 137 and left housing 123 without departing from the spirit of the present invention.

A spring member 142 is supported on leg 137 and is positioned intermediate leg 137 and the bottom surface of platform 121. While a variety of spring members may be utilized without departing from the spirit of the present invention, a foam block 140 is utilized in the preferred embodiment. Foam block 140 has a predetermined spring rate and may be easily interchanged with foam blocks of varying spring rates to provide exercise bench 120 with a variety of resistance levels to the user. As shown specifically in FIG. 15, foam block 140 extends substantially along the entire length of leg 137, and the entire width of platform 121.

Figure 16:
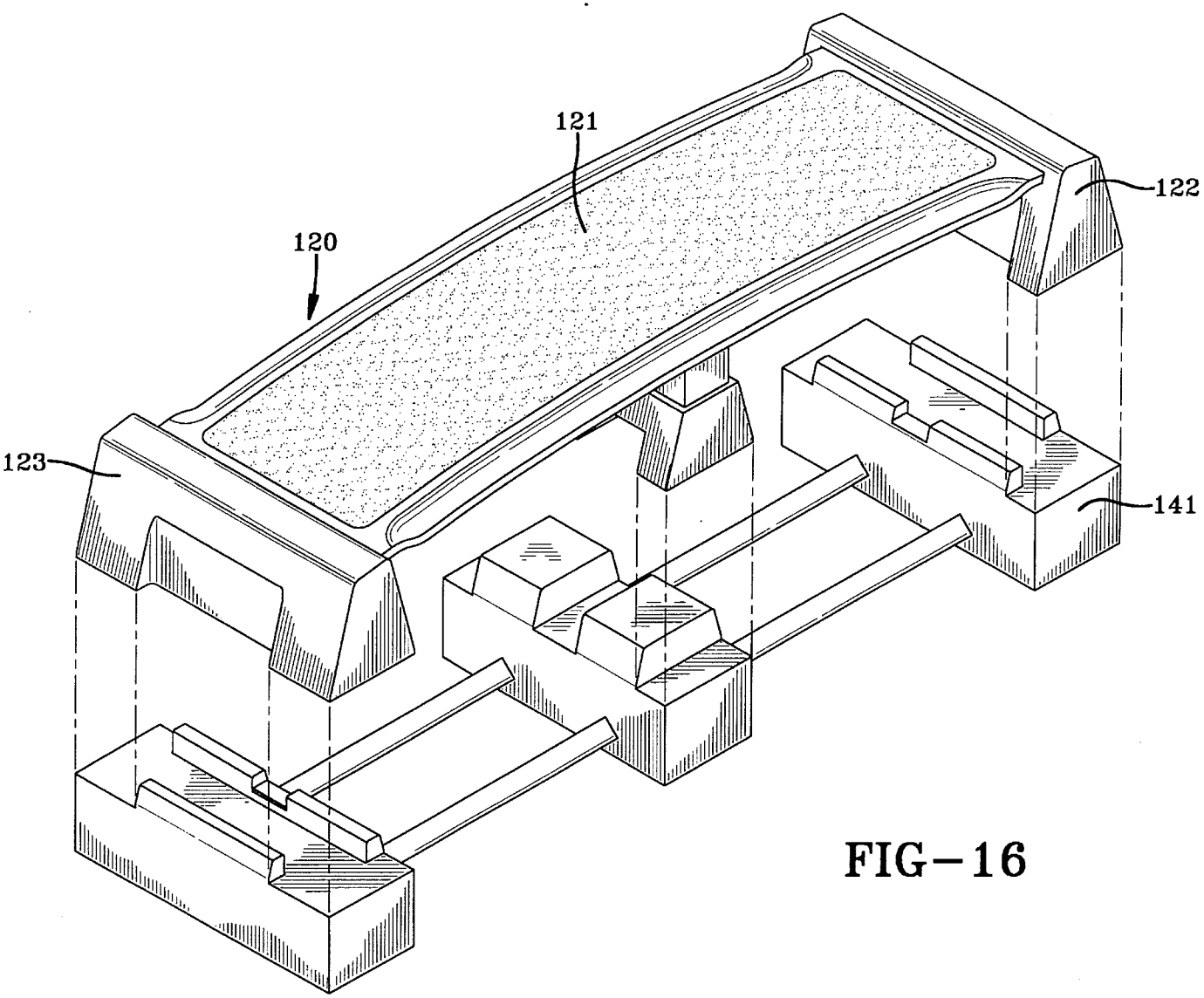
FIG. 16 is an exploded perspective view of the second embodiment of the present invention and a riser.

A riser 141, one type of which is shown in FIG. 16, may be placed under each of the right and left housings 122 and 123, respectively, and under leg 137 to increase the operating height of exercise bench 120. Such an increase will increase the intensity of the workout.

In operation, when a user steps onto exercise bench 120, the curvature of platform 121 will compress overcoming the internal spring resistance thereof as well as the resistance of vertical recoil assembly 124. As weight is applied to platform 121, it will collapse under the user's weight and flatten relative to its normal flexed position as previously described. Platform 121 will then elongate and the ends thereof will extend into voids 133 formed between platform ends 127 and the bottoms of slots 131. Shoulders 132 will prevent lateral movement of the platform within slots 131. Thus, the platform ends "float" within the spaced end supporting platforms and are not fixed as in most prior art exercise benches.

Figure 17:
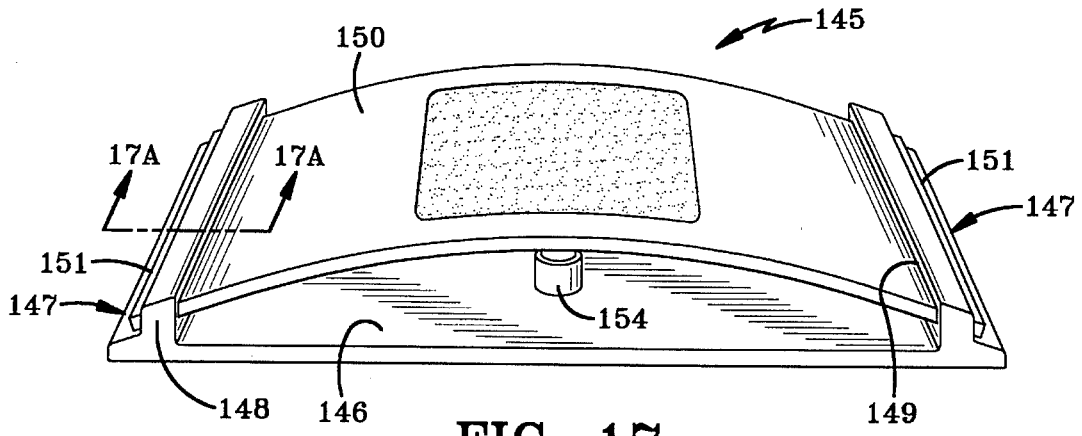
FIG. 17 is a perspective view of a third embodiment of the present invention.
Figure 17A:
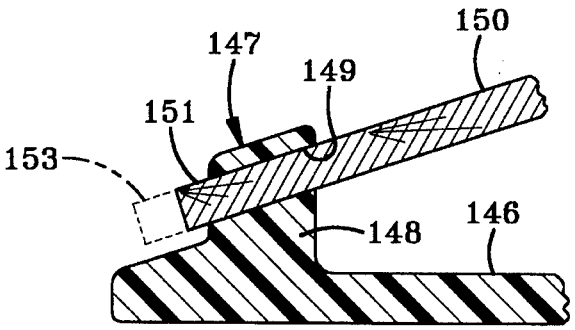
FIG. 17A is an enlarged fragmentary sectional view taken on line 17A—17A, FIG. 17.

A third embodiment of the exercise bench is indicated generally at 145, and is shown in FIGS. 17 and 17A. Bench 145 includes a substantially rectangular flat planar base 146 and a pair of identical end members 147. Each end member 147 includes an upstanding generally rectangular-shaped support 148 formed with a transversely extended through slot 149. A arcuate-shaped resilient platform 150 generally similar to platforms 22 and 121 discussed above, has a pair of ends 151 which are slidably mounted in and extend through slots 149. The slidable mounting of platform ends 151 in the slots of end member supports 148 provides for the sliding or "floating" mounting of the platform with respect to the base so that upon a vertical force being exerted on the top surface of platform 150, the ends will move slightly outwardly as the platform flattens, as shown by dot-dash lines 153 (FIG. 17A). Again, this increases the resiliency of the platform and has been found to prevent tipping of the platform when the vertical load is applied off center from the longitudinal centerline of the platform. A vertical recoil assembly 154, which may be similar to recoil assembly of FIGS. 1–10, preferably is mounted beneath the center of platform 150 and rests upon the top surface of base 146.

Figure 18:
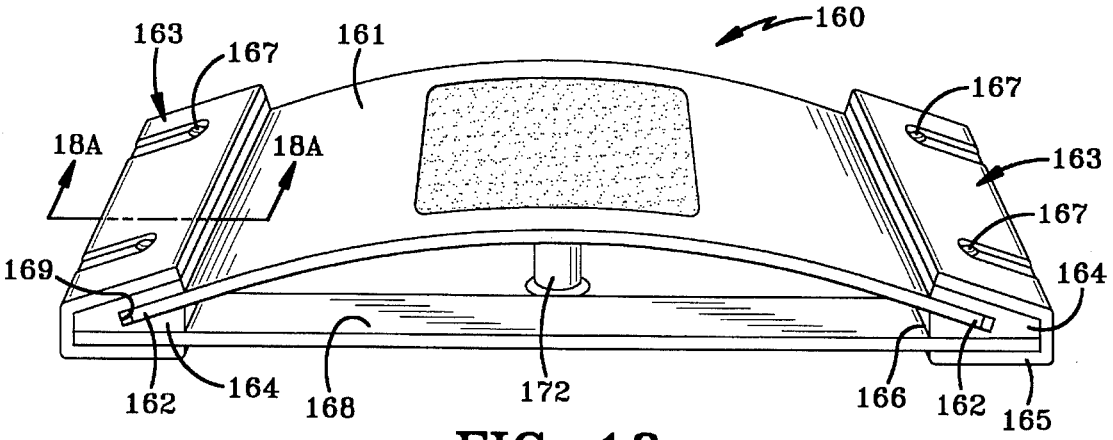
FIG. 18 is a perspective view of a fourth embodiment of the present invention.
Figure 18A:
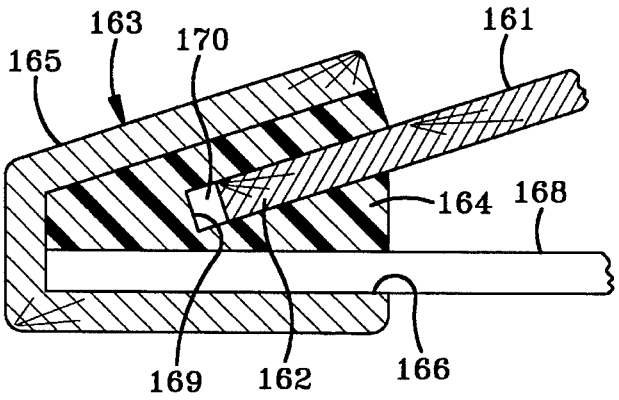
FIG. 18A is an enlarged fragmentary sectional view taken on line 18A—18A, FIG. 18.

A fourth embodiment of the exercise bench of the present invention is indicated generally at 160, and is shown in FIGS. 18 and 18A. Bench 160 includes a platform 161 similar to the previously described platforms, with its ends 162 being slidably mounted and trapped within a pair of end members, each of which is indicated generally at 163. Each end member 163 includes an internal wedge-shaped block 164, preferably formed of a rigid plastic, which is mounted within the interior of a U-shaped housing 165. Block 164 can be slidably mounted through the open end 166 of housing 165 and secured therein by a plurality of fasteners 167 or other types of retaining means. A pair of retaining or stretcher bars 168, only one of which is shown in FIG. 18, extend between and interconnect housings 165. Bars 168 may be separate members formed of plastic, metal, wood or the like, or could be molded integrally with housing 165 which in the preferred embodiment would be a rigid plastic.

Again, in accordance with one of the main feature of the invention, platform ends 162 are slidably movably mounted within slots 169 formed in blocks 164. As shown in FIG. 18A, slots 169 have a sufficient depth to provide a void 170 between the end edges of platform 169 when it is in its normal at-rest state, in order to permit the ends to slide in slots 169 upon a vertical force being applied to the platform and the platform moving towards a flatter condition. A vertical recoil assembly 172 will extend between the underside surface of the center of platform 165 and the supporting floor or surface to assist in absorbing vertical forces.

Figure 19:
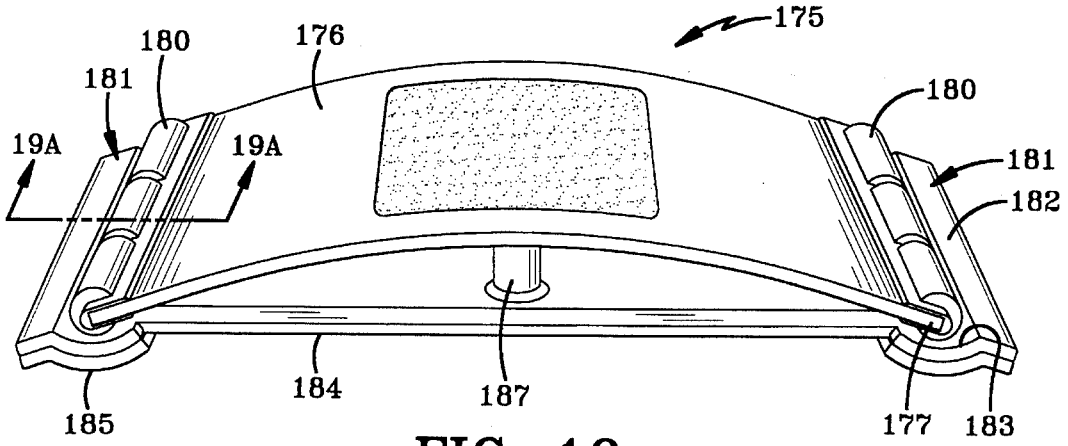
FIG. 19 is a perspective view of a fifth embodiment of the present invention.
Figure 19A:
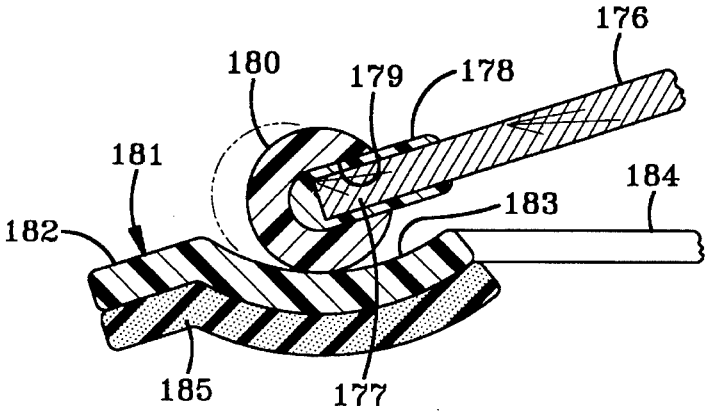
FIG. 19A is an enlarged fragmentary sectional view taken on line 19A—19A, FIG. 19.

A fifth embodiment of the improved exercise bench is indicated generally at 175 and is shown in FIGS. 19 and 19A. Bench 175 includes a usual platform 176, the ends 177 of which are retained within a U-shaped channel 178 or similar structure which, in turn, is seated within elongated slots 179 formed in a plurality of spaced rollers 180. Rollers 180 preferably are formed of a rigid plastic material and have a cylindrical configuration.

Rollers 180 are mounted in end members, indicated generally at 181, which include a top portion 182 formed with a concave recess 183, in which rollers 180 are placed. A pair of retaining or stretcher bars 184, only one of which is shown in FIG. 19, may be formed integrally with top portion 182 and extend longitudinally between the spaced end members to provide a rigid supporting base for bench 175. The mounting of rollers 180 on the ends of platform 176 again provides the desired "floating" movement of the platform with respect to the end members. It is readily seen that when a vertical force is applied to platform 176, the platform will tend to flatten out and thus will move rollers 180 slightly outwardly within concave recesses 183, as shown by dot-dash lines in FIG. 19A. Again, it has been found that this floating movement of the platform ends within the spaced end members increases the resiliency of the platform, and more importantly, prevents the platform from tipping when the user steps on the platform at an off-center position.

A resilient pad of material 185, preferably having a shape complementary to that of end members 181, is mounted on the bottom surfaces of members 181 in order to provide a non-skid, anti-creep surface to the exercise bench. A vertical recoil assembly 187 preferably will be used with bench 175, as with the previous bench constructions discussed above.

Again, each of the various embodiments shown in the drawings and discussed above provides for the floating or slidably movable mounting of the platform ends in the end members to assist in absorbing the force exerted on the platform, but most importantly, preventing the tipping of the bench when stepped upon in an off-center position by a user, since the platform ends will slide and move outwardly within the end members in relationship to the unbalanced forces exerted thereon by such an uncentered vertically applied force. The platforms for the various embodiments discussed above preferably have a length which is approximately two and one-half times the transverse width.

Accordingly, the recoiling exercise bench is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved recoiling exercise bench is constructed and used, the characteristics of the construction, and the advantageous, new and useful results obtained; the new and useful structures, devices, elements, arrangements, parts and combinations, are set forth in the appended claims.

I claim:

1. An exercise device comprising:

an arcuate flexible platform having a top surface and a pair of ends, said platform being movable between an at-rest flexed position and an elongated position when a vertical force is applied on the top surface of the platform;

first and second end members, each of said end members having a housing with a flat bottom wall for supporting the device on a support surface, an inner wall, a pair of spaced end walls, and a slot formed in the inner wall and extending laterally between the end walls for slidably receiving the ends of the platform therein, each of the housing slots terminating prior to said end walls and defining end members for preventing lateral movement of the platform ends within said slots, said slots having a depth sufficient to permit the ends of the platform to move longitudinally into said slots when the vertical force is applied to said platform.

2. An exercise device as defined in claim 1 in which vertical recoil assembly means is positioned below the platform for resisting vertical forces acting on the top surface of said platform.

3. An exercise device as defined in claim 2 in which stretcher means extends between the end members for stabilizing the device.

4. An exercise device as defined in claim 3 in which the stretcher means is a bar which extends through an aperture formed in the vertical recoil assembly means; and in which the vertical recoil assembly means is positioned intermediate said end members.

5. An exercise device as defined in claim 2 in which the vertical recoil assembly means includes a leg and spring member positioned intermediate said leg and said platform.

6. An exercise device as defined in claim 5 in which the spring member includes a foam pad.

7. An exercise device as defined in claim 1 in which the platform further includes a pair of side edges; and in which said side edges are beveled away from the top surface substantially along the entire distance between said housings.

8. An exercise device as defined in claim 1 further comprising riser means for increasing the overall height of the exercise device; and in which the bottom wall of both the end members releasably engage said riser means.

9. An exercise device as defined in claim 1 in which the platform is a one-piece member having a longitudinal length approximately two and one-half times its transverse width.

10. An exercise device as defined in claim 1 in which the platform is a single rectangular piece of laminated wood.

11. An exercise device comprising:

first and second end members;

an arcuate flexible platform having a top surface and a pair of ends;

retention means for retaining each of the platform ends within a respective one of the end members and for permitting outward movement of said platform ends within said end members when a vertical force is applied on the top surface of said platform;

vertical recoil assembly means positioned below the platform and intermediate the end members for resisting vertical forces acting on the top surface of said platform; and stretcher means extending between the end members for stabilizing the device, said stretcher means including a bar which extends through an aperture formed in the vertical recoil assembly means.

* * * * *